US007174599B2

(12) United States Patent
Stiles

(10) Patent No.: US 7,174,599 B2
(45) Date of Patent: Feb. 13, 2007

(54) ERGONOMIC SHIELDING TOOL FOR PROCESSING A SURFACE

(76) Inventor: Ronnie J. Stiles, 1310 Brittle Creek Dr., Matthews, NC (US) 28105

( * ) Notice: Subject to any disclaimer, the term of this patent is extended or adjusted under 35 U.S.C. 154(b) by 368 days.

(21) Appl. No.: 10/250,276

(22) Filed: Jun. 19, 2003

(65) Prior Publication Data

US 2004/0255975 A1 Dec. 23, 2004

(51) Int. Cl.
*A47L 13/02* (2006.01)
*A47L 13/50* (2006.01)

(52) U.S. Cl. ..... 15/257.01; 15/236.01; 118/504; D8/16; D32/46

(58) Field of Classification Search ..... 15/235.4, 15/236.01, 236.02, 245.1, 257.01; 118/504; D8/16, 45; D32/35, 46
See application file for complete search history.

(56) References Cited

U.S. PATENT DOCUMENTS

D23,068 S * 2/1894 Leggett ..... D32/46
695,965 A * 3/1902 Taylor et al. ..... 118/504
1,261,844 A * 4/1918 Orr ..... 7/105
1,292,071 A * 1/1919 Roe ..... 118/504
1,398,864 A * 11/1921 Kelly ..... 15/171
1,434,903 A * 11/1922 Manning ..... 118/504
2,332,579 A * 10/1943 Kirby ..... 118/505
2,425,215 A * 8/1947 West ..... 15/245.1
2,889,804 A * 6/1959 Dim et al. ..... 118/504

(Continued)

FOREIGN PATENT DOCUMENTS

WO WO 99/26516 A1 6/1999

(Continued)

OTHER PUBLICATIONS web address-->www.epaintstore.com.

(Continued)

*Primary Examiner*—Mark Spisich
(74) *Attorney, Agent, or Firm*—Summa, Allan & Additon, P.A.

(57) ABSTRACT

The invention is a one-piece ergonomic shielding tool that can be held in one hand to define a boundary against which a surface is processed on one side and protected from processing steps on the opposite side. The invention achieves this utility by providing a handle that is ergonomically fitted for the human hand to allow prolonged use without fatigue or injury to the user. The invention includes a straight edge, or guide edge, for dividing a surface into two regions and a curved handle for ergonomic hand-held use. The ergonomic shielding tool and a paint removal apparatus are useful in combination for scraping paint from one section of a surface and leaving another section protected from the paint removal process. The tool is adapted for use in a method of removing dried paint from a surface in a precise manner.

11 Claims, 1 Drawing Sheet

U.S. PATENT DOCUMENTS

| | | | | | |
|---|---|---|---|---|---|
| 3,788,274 | A | * | 1/1974 | McNaughton et al. | 118/504 |
| 4,051,808 | A | * | 10/1977 | Trupp | 118/504 |
| D272,981 | S | * | 3/1984 | Justice | D8/16 |
| 4,709,478 | A | | 12/1987 | Cortelyou, Jr. | |
| 4,791,007 | A | * | 12/1988 | Gleason et al. | 427/282 |
| 5,289,609 | A | | 3/1994 | Olson | |
| D383,267 | S | * | 9/1997 | Emmerth | D32/46 |
| 5,692,265 | A | | 12/1997 | Dalury | |
| 5,822,825 | A | * | 10/1998 | West | 15/236.02 |
| 5,857,241 | A | | 1/1999 | Camp, Jr. et al. | |
| 6,018,836 | A | | 2/2000 | Williams | |
| 6,044,516 | A | | 4/2000 | Lev | |
| 6,145,151 | A | | 11/2000 | Herron et al. | |
| 6,523,219 | B1 | | 2/2003 | Anderson | |
| 2002/0104182 | A1 | | 8/2002 | Panfili et al. | |
| 2003/0024074 | A1 | | 2/2003 | Hartman | |

FOREIGN PATENT DOCUMENTS

| | | |
|---|---|---|
| WO | WO 01/01842 A1 | 1/2001 |

OTHER PUBLICATIONS web address-->http://paint-and-supplies.aubuchonhardware.com.
web address-->www.plazahardware.com.
web address-->www.homefree.co.uk.

* cited by examiner

ERGONOMIC SHIELDING TOOL FOR PROCESSING A SURFACE

BACKGROUND OF INVENTION

The present invention relates to an ergonomic hand-held tool (10) with a straight edge (13) that is useful for dividing a surface into two regions an exposed region and a shielded regionon either side of the straight edge. The tool facilitates the application or removal of material on the exposed region of a surface while simultaneously protecting the shielded region.

The application or removal of material from a surface takes place in wide variety of scenarios. A few well known instances include painting walls or other structures, staining furniture to a desirable color, and removing rust from metal objects. Industrial applications often require even more precise surface processing, such as using caustic chemicals to treat specific areas of a surface while leaving a second area unchanged. These types of precise surface processing methods require means of distinguishing from a surface area to be processed and a surface area to be left unchanged. The person performing these surface processes obtains a more precise result by distinguishing different sections of a surface and focusing on each in turn.

A glass surface, such as a window pane held in place by a frame, often proves to be one of the more difficult surfaces to treat. It is often desirable, for example, to paint the frame holding a window pane without painting the window itself. Regardless of the careful painting methods involved, a painter often finds that paint spills off the frame and covers part of the window. Dried paint on a window is typically an undesirable result.

Many techniques have evolved to ease the difficulty of painting a window frame without painting the associated window. One of the more common methods is that of applying tape to the window pane right up to the edge of the frame holding the pane. The painter then applies paint to the frame with the expectation that any excess paint will land on the tape instead of the glass window. When the frame is completely painted, the painter removes the tape to reveal a clean glass.

The taping method is not always the answer, however. First of all, applying tape to all of the edges of a window pane may be just as time consuming and difficult as scraping the glass to rid excess paint.

Second, depending on the width of the tape, there is no guarantee that the tape will completely protect the glass. Third, tape will only stick to glass by use of an adhesive, and this adhesive often remains on the glass after removing the tape. In this case, the painter avoids scraping paint off the window, only to be left scraping the tape adhesive off the window instead. Finally, applying a tape border around window frames has implications for the quality of the resulting paint job. If the tape is applied unevenly, then the window frame may be painted unevenly as well, resulting in a sloppy edge.

Due to the problems associated with window taping, some painters have chosen to paint window frames without too much concern for applying paint to the subject window pane. The painter then scrapes the window panes of excess paint after completely painting the frame, leaving a smooth edge of paint between the frame and the window pane.

Scraping window panes of excess paint can be a time consuming and arduous task. The scraping tool must be sharp enough to remove dried paint without scratching or breaking the window. One traditional paint scraping tool used on windows is a razor blade. A razor blade is sufficiently sharp for the job, but a razor blade is very difficult to use by hand. The small size of a razor blade makes it difficult to use for extended periods of time without exhausting or even injuring the user's hand. The razor blade is of limited applications, therefore, because the razor blade is not conducive for use on large windows or a great number of windows that need to be scraped quickly.

The painting industry has recognized the inherent problems incurred when scraping paint from surfaces. Several tools have been previously developed to assist in removing paint from surfaces in a desired fashion. Commercially available scrapers for painting, dry wall processing, putty application, etc. are common in today's construction markets. These tools, however, often suffer the drawback of being uncomfortable to use for extended periods due to handles that do not easily fit the user's grip. Most of these tools also include a blade type of scraper attached to a separate handle. These tools, therefore, include multiple parts that must be assembled to make a complete device.

Fabrication of tools with many pieces is difficult because individual components must be linked together in manufacturing the scraper.

Tools that are useful for processing a surface, such as scrapers for dried paint, have two common deficiencies. First, many tools are too large and cumbersome for detailed work that requires precise processing of one area of a surface while simultaneously leaving a second area of the surface unchanged. For instance, in the paint scraping example, a painter often desires to remove excess paint from a surface right up to a specific edge without damaging paint on the opposite side of the edge. Commonly available tools are inappropriate for these types of applications in which a user seeks precision and detail.

Another problem in commonly available tools for surface processing is that of ergonomics. Common tools, such as paint brushes, hammers, scrapers, etc. typically include handle designs that have been available for centuries. Industries have only recently begun to study the impact that poorly designed handles have on the user's grip, comfort, and associated endurance in using the tool.

The inventor herein determined that a well designed handle is critical for a tool's optimal use. For hand-held tools that are used for extended periods of time in the same or similar position, the handle can be instrumental in a good result. The inventor herein describes and claims a new ergonomic handle that allows extended use with a better grip and less fatigue during extended hand-held use. The ergonomic handle allows for better precision in processing a surface for longer periods of time.

Prior filed patent applications and previously issued patents show that presently available tools are deficient in regard to the two most problematic areasuse on surfaces requiring precise detail and use for extended periods without fatigue caused by a poorly designed handle. A brief review of art relevant to these issues is indicative of deficiencies in the market today.

In regard to better handles on tools, particularly surface processing tools, U.S. Patent Application No. 2002/0104182 A1 (Panfili et al.), published on Aug. 8, 2002 and entitled Ergonomic Drywall Knife, is indicative of a standard tool handle that attempts to include ergonomic improvements. The application recites a handle for a drywall knife that is lighter due to recesses within the inner core of the handle. The Panfili '182 handle also includes finger grips in various positions that supposedly allow diverse grips with better comfort. The Panfili '182 handle is manufactured by a molding process and attached to the drywall knife blade in a separate manufacturing step.

U.S. Pat. No. 5,857,241 issued to Camp, Jr. et al. on Jan. 12, 1999 shows another handle modification, known as a "soft grip handle." The patent recites a contoured handle for a paint roller, or the like. The patent also shows that the contoured handle comprises a rigid inner core surrounded by a softer outer grip designed to provide a more comfortable fit for the user's hand. The Camp '241 patent also provides ribbing and finger grooves on the outer portion of the handle to enhance the grip quality of a tool with the claimed handle.

The Panfili '182 patent and the Camp '241 patent continue to rely upon variations of the traditional cylindrical handle. The patents provide cushioning and grippers but include only minor enhancements to the known art. These patents also require attaching the claimed handles to other separate components of the overall tool, a step which the manufacturing process.

Another collection of known art attempts to improve tool handles by conforming the shape of the handle to a standard fist grip. This collection includes U.S. Pat. No. 5,692,265 issued to Dalury on Dec. 2, 1997, and Dalury's PCT counterpart WO 99/26516, published on Jun. 3, 1999. These publications show a tool handle shaped for the user to grip around the body of the handle, with the user's fingers fitting into pre-formed finger grooves. The handle would mainly serve in applications such as hammers or wrenches requiring a tight working grip with the user's hand positioned in a fist around the handle.

U.S. Pat. No. 6,145,151 issued to Herron, et al. on Nov. 14, 2000, shows finger grooves in a paint brush handle to add comfort during use. This handle may be used with a scraper head also.

A final collection of tools for processing various surfaces shows fabricated from metals or other formable materials that are curved to fit a user's hand. U.S. Patent Application No. 2003/0024074 A1 published by Hartman on Feb. 6, 2003 shows a handle with a biconcave-shaped cross section that is suitable for a hand tool, a hand tool extension, a tool connector, etc. The handle is designed to replicate the recess formed by the human hand when gripping an elongated object.

U.S. Pat. No. 6,018,836 issued to Williams on Feb. 1, 2000, recites an elongated arch of material of uniform thickness, useful for scraping a surface to rid the surface of unwanted material. A simple arch of metal or other material, however, has the significant drawback of causing discomfort or injury to the user after extended periods. The uniform thickness of the arch would eventually wear on the user's hand, and the article offers no significant means of avoiding that discomfort.

U.S. Pat. No. 6,044,516 issued to Lev on Apr. 4, 2000 recites a surface processing tool in the form of a plastering trowel. The handle of the trowel comprises a sloped, single piece body that is curved to allegedly be more comfortable for the user. The sloped ends of the handle provide a reference finger rest for the index finger to define the longitudinal position of the user's hand along the handle.

Hartman '074, Williams '836, and Lev '516 all require an assembly operation to attach the designated handles to another component of the tool. This assembly adds to the complexity, and therefore the cost, of the resulting tool.

The tools described thus far in this background information attempt to address the need for a more ergonomic handle for a wide variety of tools. These known embodiments, however, require excessive assembly steps to fabricate the final tool. Certain of the handles are also limited in their applications due to the grips that the handles allow within a user's hand. A need continues to exist, therefore, for a surface processing tool that includes an easily manufactured ergonomic handle component that is applicable to a broader array of uses.

The second problem discussed herein is the continued need for surface processing tools that may be used in applications requiring precise detail work. Many surfaces require processing in discrete sections, such as painting, stripping, chemical treating, etc. A sectional surface processing technique gives the processor more control over the surface to achieve a better defined final result. For instance, in painting, a user often desires to apply or remove paint from a specific area of a surface, up to a defined edge, and leave the remainder of the surface unchanged until a later step. In the case of window frame painting, as discussed above, a need exists to enable the painter to remove dried paint from a window without affecting the associated window frame. The painter in this scenario needs a tool to divide a surface into an exposed region from which paint will be removed and a protected region, such as a window frame, on which paint should remain.

Several issued patents have attempted to address the need for a precise surface processing tool, particularly useful in the painting industry. Expired U.S. Pat. No. 5,289,609 issued to Olson on Mar. 1, 1994 recites a guide for cleaning paint from a window. The guide of Olson '609 is designed to be used with a razor blade or other scraping mechanism. In use, the Olson '609 guide is held against a surface so that an end of the guide provides a straight edge defining a line between paint to be removed and paint to remain after scraping. The Olson '609 guide is made of a very thin sheet and provides no comfortable means of gripping the guide. The Olson '609 apparatus, therefore, suffers the previously discussed problem of user fatigue or even injury after prolonged use. The only means for holding the Olson '609 guide is by pinching the guide between two fingers, a position that is not ergonomically beneficial to the user's hand.

U.S. Pat. No. 6,523,219 issued to Anderson on Feb. 25, 2003, provides a scraper guide assembly that includes a side shield to be placed against a window frame or similar surface. A separate tool is used with the Anderson '219 guide to scrape material off of a surface. Anderson '219 recites a traditional cylindrical handle that lacks a convenient ergonomic quality. The Anderson '219 tool furthermore requires the handle and the side shield to be fabricated separately and assembled by traditional means. This assembly requires more effort and increases the cost of manufacturing a complete tool.

The publications discussed above show a definite need for an apparatus that includes an ergonomic handle without requiring specialized assembly and costly manufacturing processes for fabrication. Tools available in today's marketplace also lack optimal utility in applications that require extra degrees of precision in processing or treating a surface. The inventors herein meet these needs with invention described and claimed herein.

The publications cited above generally relate to the painting industry, and painting is a good example of the utility of the claimed invention. The inventors, however, describe and claim the invention in terms of broader applications for a variety of uses. The more specialized features of the invention are highlighted with illustrations in the context of scraping paint. The paint scraping uses of the claimed invention are for the ease of example only. Unless specifically claimed in a particular embodiment, the use of the ergonomic shielding tool in painting applications is not intended to limit the scope of the claimed invention herein.

SUMMARY OF INVENTION

The invention herein is an ergonomic shielding tool (10) that can be held in one hand to define a boundary against which a surface is processed on one side and protected from processing steps on the opposite side. The invention achieves this utility by providing a handle (20) that is well-fitted for the human hand to allow prolonged use without fatigue or injury to the user. In use, the invention simultaneously shields one section of a surface while exposing the second section of the same surface for treating the invention herein can be used in any number of applications wherein a surface is being treated in sections. The inventors do not wish to be limited by one particular use of the invention, but the tool is readily adapted for use in guiding a paint scraper, setting boundaries for paint or other chemicals to be applied to a surface, or other mechanisms by which a surface is changed in some fashion requiring a controlled exposure of different portions of the surface. The inventor herein describes the tool and its uses in four embodiments. The first embodiment is a one-piece ergonomic shielding tool (10) with a straight edge (13) for dividing a surface into two regions and a curved handle (20) for ergonomic hand-held use. The second embodiment shows a one-piece ergonomic shielding tool (10)formed in a substantially planar sheet of material. The tool is composed of a straight guide edge (13) at one end of a guide panel (15), a shielding panel (15) extending at an angle from the guide panel (17), and an ergonomically curved handle (20) extending from the guide panel (15). The third embodiment is a combination of the ergonomic shielding tool (10) and a paint removal apparatus (30) for use in scraping paint from one section of a surface and leaving another section protected from the paint removal process. The fourth embodiment is a method of removing dried paint from a surface and utilizing the ergonomically enhanced shielding tool (10) according to the method of the invention.

DETAILED DESCRIPTION

Figure 1:
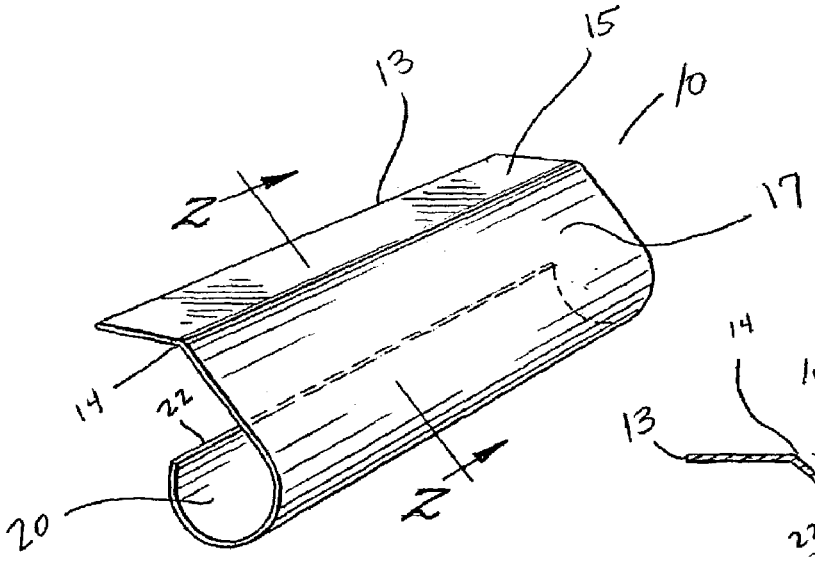
FIG. 1 is a plan view of the ergonomic shielding tool as shown from an axis that intersects the guide panel 15 and the shield panel 17 of the tool.

The invention herein is an ergonomic shielding tool (10) that facilitates the application or removal of material on a surface by dividing a surface into a protected region and an exposed region.

In a first embodiment, the tool includes a single-piece body (10) of substantially uniform thickness with a straight edge (13) at a first end of the body. The user places the straight edge (13) against a surface to separate the surface into first and second regions on opposite sides of the straight edge. These separate portions of the surface may be distinctly processed, depending on the use at hand.

The body of the tool (10) may be made of a substantially planar sheet of material of substantially uniform thickness. The selected material can be metal, plastic, rubber, or any other convenient material that is formable into the desired shape with a straight edge (13) at a first end of the sheet. A sheet of formable material may be conveniently bent and curved to form the invention claimed here. Alternatively, common molding techniques are equally pertinent to fabricating the tool claimed herein. Shaping a single sheet of a material, such as a metal, is the simplest means of fabricating the tool and is the most commonly used example herein; however, the inventor does not wish to limit the breadth of this tool by any one fabrication method.

The sheet is curved on the end of the sheet directly opposite the straight edge (13) to form a handle (20) for holding the straight edge (13) against a surface. The curved portion (20) of the sheet provides a convenient and ergonomic handle (20) for holding the tool during use.

Figure 2:
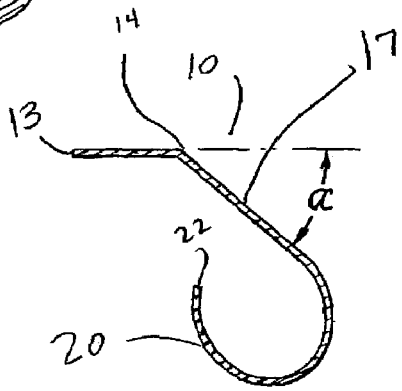
FIG. 2 is a side view of the ergonomic shielding tool (10) according to the present invention.

The sheet includes a bend (14) near the first end along a line parallel to the straight edge (13) to form an angle (a) as shown in FIG. 2 in the body (10) between the straight edge (13) and the handle (20). The angle (a) of the bend (14) in the body (10) is preferably no greater than ninety degrees. The angular shape of the tool (10) allows the straight edge (13) to separate a surface into two portions. A first portion of the surface on one side of the straight edge is exposed for processing. A second portion of the surface, opposite the straight edge, is protected by the body of the tool.

The angular shape of the tool body adds to the ergonomic nature of the tool. The angle (a) allows the straight edge (13) to be placed flush with the surface and the tool automatically covers a portion of the surface due to the body of the tool extending at an angle that is less than ninety degrees. This angle (a), as shown in FIG. 2 allows a more natural working position when the tool is in use.

The straight edge (13) and the handle (20) are therefore integrally formed in one sheet of the material. The use of a formable sheet of material, such as a metal sheet, allows for simple fabrication of the tool. No separate assembly is required for the handle to be attached to the body of the tool.

The curved handle (20) is positioned at a second end of the body, opposite the straight edge (13), for gripping the body and holding the straight edge (13) against the surface. The curved handle (20) may be rounded to provide an ergonomic fit in a user's hand. The ergonomically fitting handle (20) allows the user to hold the shielding tool (10) for extended periods of use without fatigue, hand cramping, or even injury.

The curved handle (20) may be an arced section of the body of the shielding tool (10) such that the handle (20) is integral with the body of the tool (10). In operation, this arced section of the shielding tool extends along the palm of a user's hand when gripping the handle (20), allowing the straight edge (13) at the opposite end of the tool to be positioned as desired. The curved handle (20) may terminate at one end of the sheet in a standard linear edge (22) as shown in FIG. 2.

Alternative embodiments may include a contoured edge at the end of the handle (20). In one embodiment, the end of the sheet (22) comprising the handle (20) may include finger-shaped contours to enhance the user's grip on the handle. The user grips the handle (20) with the arced portion of the sheet fitting the user's palm, and the user's fingers rest in the contours, or "finger-grips," on the end (22) of the handle (20).

The tool may also include other features to make the handle (20) portion of the tool more comfortable during use.

The handle end of the sheet could be covered in a material that enhances the gripping quality of the handle. By "gripping quality," the inventor refers to the comfort, stability, and ergonomic nature of the handle that ensures quality use for extended periods of time without discomfort or fatigue. To enhance the gripping quality of the handle (20), the inventor herein discloses that the handle (20) may be covered with materials made of rubber, fabric, plastic, or other products that provide cushioning and stability to the tool (10) in the user's hand. The handle (20) could also include raised bumps in the sheet, arranged as rows of dots, that provide a better grip.

A second embodiment of the ergonomic shielding tool (10), described and claimed herein, also facilitates the application or removal of material on a surface. Similar to the first embodiment, the second embodiment of the invented tool (10) is operable to divide a surface into a protected region and an exposed region.

The second embodiment includes a single-piece body (10) having a substantially rectangular guide panel (15) with a guide edge (13) at one end. The guide edge (13) is straight, and in use, the guide edge (13) is placed flush against a surface. The guide edge (13) against a surface separates the surface into two regions on opposite sides of the guide edge (13).

The tool (10) further includes a shield panel (17) extending at an angle (a) from the guide panel (15), opposite the guide edge (13), to protect and cover a portion of the surface on one side of the guide edge (13). The portion of the surface on the opposite side of the guide edge (13) is exposed for further processing.

The second embodiment of the tool further includes a curved handle (20) extending from the shield panel (17), opposite the guide panel (15), for gripping the body (10) and holding the guide edge (13) against a surface. In use, when the straight guide edge (13) is flush against a surface, the shield panel (17) covers a first portion of the surface, and a second portion of the surface remains uncovered.

The guide panel (15), the shield panel (17), and the handle (20) of the second embodiment of the tool are integrally formed in one sheet of material. In this sense, both panels and the handle of the tool may be fabricated from a substantially planar sheet of material of substantially uniform thickness. The selected material can be metal, plastic, rubber, or any other convenient material that is formable into the desired shape with a straight guide edge (13) at a first end of the sheet.

A sheet of formable material may be conveniently bent and curved to form the invention claimed herein as the second embodiment. Alternatively, common molding techniques are equally pertinent to fabricating the tool claimed herein. Shaping a single sheet of a material, such as a metal, is the simplest means of fabricating the tool and is the most commonly used example herein; however, the inventor does not wish to limit the breadth of this tool by any one fabrication method.

The end of the sheet adjacent the shield panel (17) of the tool (10) and opposite the guide panel (15) of the tool is curved to form a handle (20) for holding the guide edge (13) against a surface. The curved portion of the sheet provides a convenient and ergonomic means for holding the tool.

The guide panel (15) and the shield panel (17) do not have to be separate pieces requiring assembly. The elegant design herein provides for the guide panel (15), the shield panel (17), and the handle (20) to be formed within a single continuous sheet of material.

The sheet extends a certain distance from a first straight edge, or guide edge (13). This first extension of the sheet forms the guide panel (15). The guide panel (15) extends to a desired length of the sheet, at which length the sheet is bent along a line parallel to the straight guide edge (13). This bend (14) in the sheet forms an angle (a) in the body of the tool (10) between the straight guide edge (13) and the handle (20). The angle (a) of the bend in the body is preferably no greater than ninety degrees.

The sheet extends at this angle (a) for another desired length of the sheet, forming the shield panel (17). The shield panel (17), therefore, extends at an angle (a) from the guide panel (15) with both panels being formed in a continuous sheet of formable material. The angular shape of the tool allows the straight guide edge (13) to separate a surface into two portions. A first portion of the surface on one side of the straight edge (13) is exposed for processing. A second portion of the surface, opposite the guide edge (13), is protected by the shield panel (17) of the tool.

As in the first embodiment, the angular shape of the tool body adds to the ergonomic nature of the tool. The angle (a) allows the guide edge (13) to be placed flush against a surface so that the shield panel (17) of the tool automatically covers a portion of the surface. The angular extension of the shield panel (17) allows a more natural working position when the tool is in use.

The curved handle (20) of the second embodiment is identical to the curved handle (20) of the first embodiment. The curved handle (20), again, may be an arced section of the sheet from which the shielding tool is made. The curved handle (20) of the second embodiment, therefore, extends in the sheet from the shield panel (17) to a second end of the sheet.

In operation, the arced handle section (20) of the shielding tool extends along the palm of a user's hand when the handle (20) is gripped, allowing the guide edge (13) at the opposite end of the tool to be positioned as desired.

The curved handle (20) may terminate at one end of the sheet in a standard linear edge (22) as shown in FIG. 2.

The finger-grips and grip-enhancing covers for the handle, as described in the first embodiment, are equally applicable to the second embodiment as described herein.

Although the inventor does not wish to be limited to any single use of the invention, one practical use of the invention is in the area of scraping paint from a surface such as a window. The shielding tool (10) divides the surface into an area to be scraped and an area to remain protected from the scraping process. For example, the shielding tool is particularly useful in assisting a painter in the process of scraping a window pane held in place by a painted window frame. As discussed above, painters often apply paint to the frame and inadvertently leave undesirable excess paint on the window pane. The painter scrapes the window pane to rid the pane of the excess paint, resulting in an appealing finish.

The ergonomic shielding tool (10) described and claimed herein provides an excellent means of ensuring a quality paint scraping job for windows or other surfaces. The straight edge, or guide edge (13), of tool (10) defines a crisp, straight boundary against which excess paint may be removed.

In a paint scraping application, the ergonomic tool can be used for long periods without muscle cramps, fatigue, or injury because the curved handle described herein provides a natural working position for the user's hand.

Figure 3:
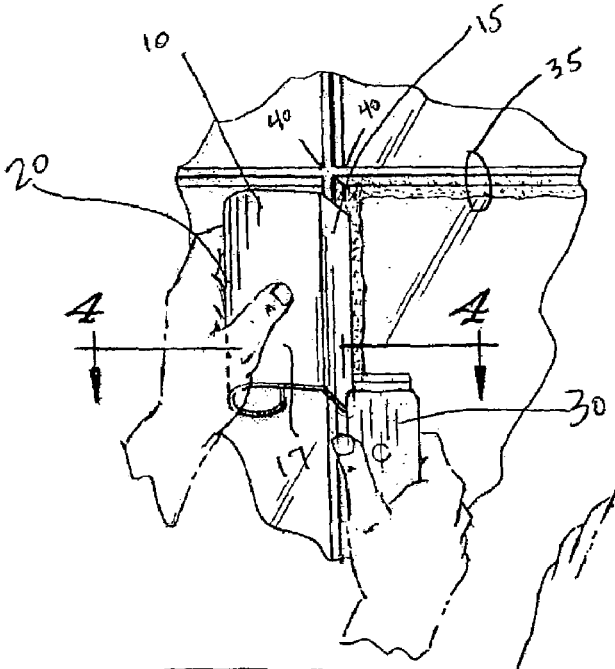
FIG. 3 is a plan view of the ergonomic shielding tool (10) in use with a paint removal apparatus (30) in combination.
Figure 4:
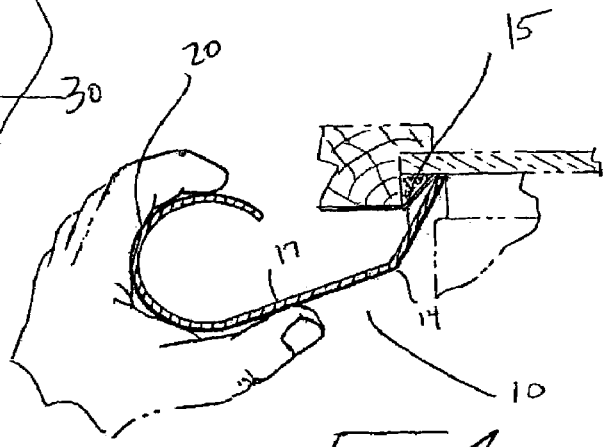
FIG. 4 is a side view of the ergonomic shielding tool (10) in use with the curved handle (20) fitting a user's grip.

An additional enhancement of the invention is the angled extension of the shield panel (17), which provides a natural covering function for portions of the surface that should not be scraped or further processed. For example, in the window pane scraping example, the guide edge (13) of the tool (10) may be placed directly against the putty line (40) of the window frame, as shown in FIG. 3. The guide edge (13) defines a straight boundary against which the window is scraped to remove any excess paint thereon.

In a window scraping procedure of FIG. 3, the angled shield panel (17) of the tool (10) covers and protects the window frame (35) from the scraping process. The result is a cleanly scraped window with a painted frame. The paint on the frame ends in a crisp edge, defined by the guide edge of the tool, and results in a pleasantly aesthetic paint job.

The context of scraping paint from a window pane gives rise to the third embodiment of the invention herein. The third embodiment is a combination of the ergonomic shielding tool (10) and a paint removal tool (30) to be used in conjunction therewith. As such, the third embodiment, described and claimed herein, encompasses an ergonomic shielding tool (10) and paint removal apparatus (30) combination for the removal of dried paint from a selected region on a surface. The surface may be a window pane held in place by a painted frame (35). Other surfaces are equally within the scope of this invention.

The shielding tool (10) and paint removal tool (30) combination includes a single-piece ergonomic shielding tool (10) with a substantially rectangular guide panel (15) with a straight guide edge (13) at one end, a substantially planar shield panel (17) extending at an angle (a) from the guide panel (15) opposite the guide edge (13), and a curved handle (20) extending from the shield panel (17) opposite the guide panel (15) for gripping the shielding tool (10) and holding the guide edge (13) against a surface. The shield panel (17) covers a first portion of the surface, and a second portion of the surface remains uncovered. The claimed combination further includes a paint removal apparatus (30) for removing paint from the uncovered second portion of the surface up to the guide panel of the shielding tool.

The shielding tool (10) of the combination as claimed in a third embodiment may include all of the features described in the first two embodiments. In fact, the shielding tool that is part of the combination of the third embodiment is identical to that of the second embodiment. The paint removal apparatus (30), claimed as part of the combination of the third embodiment, may be a hand-held paint scraper. In another aspect, the paint removal apparatus may be a machine operated paint scraper.

The inventors herein also describe and claim a method of removing paint from a window held in place by a painted frame (35). This fourth embodiment of the claimed invention is an ergonomic method of removing dried paint from a window while holding an ergonomic shielding tool (10) in one hand.

The shielding tool (10) has a one-piece body with a substantially rectangular guide panel (15) with a straight guide edge (13) at one end, a substantially planar shield panel (17) extending at an angle from the guide panel (15) opposite the guide edge (13), and a rounded handle (20) extending from the shield panel (17) opposite the guide panel (15). According to the method herein, the user grips the shielding tool (10) so that the rounded handle (20) extends along the palm of the user's hand.

The user places the guide edge (13) of the shielding tool against a window so that the shield panel (17) covers a first portion of the window, and a second portion of the window remains uncovered. The user holds the shielding tool in one hand with the straight guide edge (13) against the window. The user removes paint from the uncovered second portion of the window with a paint removal tool in the other hand.

Pursuant to the invented ergonomic paint removal method, the step of placing the guide edge of the shielding tool against the window includes placing the guide panel (15) against a painted window frame (35) that holds a window in place. The user positions the shielding tool (10) with the guide edge (13) on the window pane so that the shield panel (17) covers the window frame (35) and leaves the window pane exposed for paint removal.

The user removes the paint from the window and leaves paint on the window frame. The step of removing the paint from the window includes leaving a strip of paint between the window frame and the window to form a seal of paint between the window frame and the window. This seal of paint is helpful for a variety of reasons. First, the paint covers and protects the putty that holds the window in the frame. The paint, therefore, reduces putty cracking after prolonged exposure to sunlight or heat. The strategically placed paint seal between the window pane and the window frame also adds an insulating effect to prevent drafts from leaking through the junction of the window pane and the frame.

The step of leaving this protective strip of paint between the window pane and the window frame includes leaving a strip of paint that is between about 1/32 of an inch and 1/16 of an inch in width. This width of paint sealing the window frame is the appropriate amount for a beneficial result without leaving an undesirably wide strip of paint on window.

The step of leaving a strip of paint that is between about 1/32 and 1/16 of an inch in width is easily accomplished with the ergonomic shielding tool because the shielding tool may be formed from a sheet that is between about 1/32 and 1/16 of an inch in width. By using the shielding tool of the present invention, the painter scrapes paint from the window up to the guide edge of the shielding tool. Paint located under the guide edge of the shielding tool, which is between about 1/32 and 1/16 of an inch in thickness, remains when the scraping is complete. To accommodate this method of leaving a strip of paint of the desired width, the ergonomic shielding tool of the first, second, and third embodiments herein may be constructed of a sheet of material that is between about 1/32 and 1/16 of an inch in thickness.

The invention claimed is:

1. An ergonomic shielding tool and paint removal apparatus combination for the removal of dried paint from a selected region on a surface, comprising:

a single-piece ergonomic shielding tool of substantially uniform thickness and width comprising:

a substantially planar, rectangular guide panel with a straight guide edge at one end;

a substantially planar, rectangular shield panel extending from said guide panel opposite said guide edge, said shield panel having top and bottom surfaces, wherein an acute angle is defined between the top surface of said shield panel and a plane including said guide panel; and a curved handle extending from said shield panel and terminating in a free end turning toward and facing the bottom surface of said shield panel, the curved handle and the guide panel both being located on the same side of a plane containing the shield panel; and a paint removal apparatus for removing paint from a surface up to the guide panel of the shielding tool.

2. An ergonomic shielding tool and paint removal apparatus combination according to claim 1, wherein said curved handle of said shielding tool is rounded.

3. An ergonomic shielding tool and paint removal apparatus combination according to claim 1, wherein said curved handle of said shielding tool comprises an arced section of said tool that extends along the palm of a user's hand when said handle is gripped.

4. An ergonomic shielding tool and paint removal apparatus combination according to claim 1, wherein said shielding tool is made of a substantially planar sheet of material.

5. An ergonomic shielding tool and paint removal apparatus combination according to claim 4, wherein said sheet is made of metal.

6. An ergonomic shielding tool and paint removal apparatus combination according to claim 1, wherein said tool is bent along a line extending parallel to said guide edge to form said angle between said guide panel and said shield panel.

7. An ergonomic shielding tool and paint removal apparatus according to claim 1 wherein said paint removal apparatus is a hand-held paint scraper.

8. An ergonomic shielding tool that facilitates the application or removal of material on a surface by dividing a surface into a protected region and an exposed region, comprising:

a single-piece body of substantially uniform thickness and width, comprising:

a substantially planar, rectangular guide panel with a straight guide edge at one end thereof;

a substantially planar shield panel extending from the guide panel opposite said guide edge, said shield panel having top and bottom surfaces, wherein an acute angle is defined between the top surface of the shield panel and a plane including the guide panel; and a curved handle extending from said shield panel and terminating in a free end turning toward and facing the bottom surface of said shield panel, the curved handle and the guide panel both being located on the same side of a plane containing the shield panel.

9. An ergonomic shielding tool according to claim 8, wherein said curved handle is rounded.

10. An ergonomic shielding tool according to claim 8, wherein said curved handle comprises an arced section of said body that extends along the palm of a user's hand when said handle is gripped.

11. An ergonomic shielding tool according to claim 8, wherein said body is bent along a line of points parallel to said guide edge to form said angle in said body between said guide panel and said shield panel.

* * * * *